US009328892B2

(12) United States Patent
Matsumoto

(10) Patent No.: US 9,328,892 B2
(45) Date of Patent: May 3, 2016

(54) VEHICULAR LAMP

(71) Applicant: KOITO MANUFACTURING CO., LTD., Minato-ku, Tokyo (JP)

(72) Inventor: Hiroki Matsumoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 64 days.

(21) Appl. No.: 14/079,902

(22) Filed: Nov. 14, 2013

(65) Prior Publication Data

US 2014/0140085 A1 May 22, 2014

(30) Foreign Application Priority Data

Nov. 20, 2012 (JP) ..... 2012-254311

(51) Int. Cl.
*F21S 8/10* (2006.01)

(52) U.S. Cl.
CPC ..... *F21S 48/325* (2013.01); *F21S 48/1104* (2013.01); *F21S 48/1159* (2013.01)

(58) Field of Classification Search
CPC ..... F21S 8/10; F21S 48/325; F21S 48/1159; F21S 48/1104; F21V 29/025; F21V 29/027; F21V 29/505
See application file for complete search history.

(56) References Cited

U.S. PATENT DOCUMENTS

| | | | | |
|---|---|---|---|---|
| 8,465,189 | B2 * | 6/2013 | Inoue et al. | 362/547 |
| 8,911,125 | B2 * | 12/2014 | Suzuki et al. | 362/487 |
| 8,985,824 | B2 * | 3/2015 | Ito et al. | 362/547 |
| 2007/0035957 | A1 * | 2/2007 | Albou et al. | 362/487 |
| 2010/0020563 | A1 * | 1/2010 | Ito et al. | 362/547 |
| 2010/0253223 | A1 * | 10/2010 | Inoue et al. | 315/82 |
| 2011/0127912 | A1 * | 6/2011 | Lee et al. | 315/32 |

FOREIGN PATENT DOCUMENTS

JP 2012-074218 A 4/2012

* cited by examiner

*Primary Examiner* — Bao Q Truong
(74) *Attorney, Agent, or Firm* — Sughrue Mion, PLLC

(57) ABSTRACT

A vehicular lamp includes an optical member having a reflective surface that reflects light from a light source, a heat radiating member configured to radiate heat generated by the light source; and a blowing mechanism configured to blow air at the reflective surface.

8 Claims, 8 Drawing Sheets

VEHICULAR LAMP

INCORPORATION BY REFERENCE

The disclosure of Japanese Patent Application No. 2012-254311 filed on Nov. 20, 2012 including the specification, drawings and abstract is incorporated herein by reference in its entirety.

BACKGROUND OF THE INVENTION

1. Field of the Invention

The invention relates to a vehicular lamp.

2. Description of Related Art

Conventionally, fluorescent bulbs and light bulbs have often been used for vehicular lamps. In recent years, instead of such lamps, various light-emitting devices that use light-emitting diodes (hereinafter, referred to as "LEDs") have been developed from the viewpoint of power consumption and life. For example, Japanese Patent Application Publication No. 2012-74218 (JP 2012-74218 A) proposes technology that employs LEDs for a headlamp of a vehicle.

With a headlamp, there is a need to reduce to the number of LEDs in order to reduce costs, so the trend is to increase the energy of light emitted from each LED. The majority of light emitted from the LEDs is reflected by a reflective surface, but a very small amount of light is absorbed by the reflective surface, so the temperature of optical parts may rise. As a result, an optical member such as a reflector or a projection lens may be affected by the heat from the LED and deform.

SUMMARY OF THE INVENTION

The invention provides a vehicular lamp capable of efficiently cooling an optical member.

One aspect of the invention relates to a vehicular lamp that includes an optical member having a reflective surface that reflects light from a light source, a heat radiating member configured to radiate heat generated by the light source, and a blowing mechanism configured to blow air at the reflective surface.

This aspect enables air to be sent to the reflective surface of the optical member.

The invention thus enables a vehicular lamp capable of efficiently cooling an optical member to be provided.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
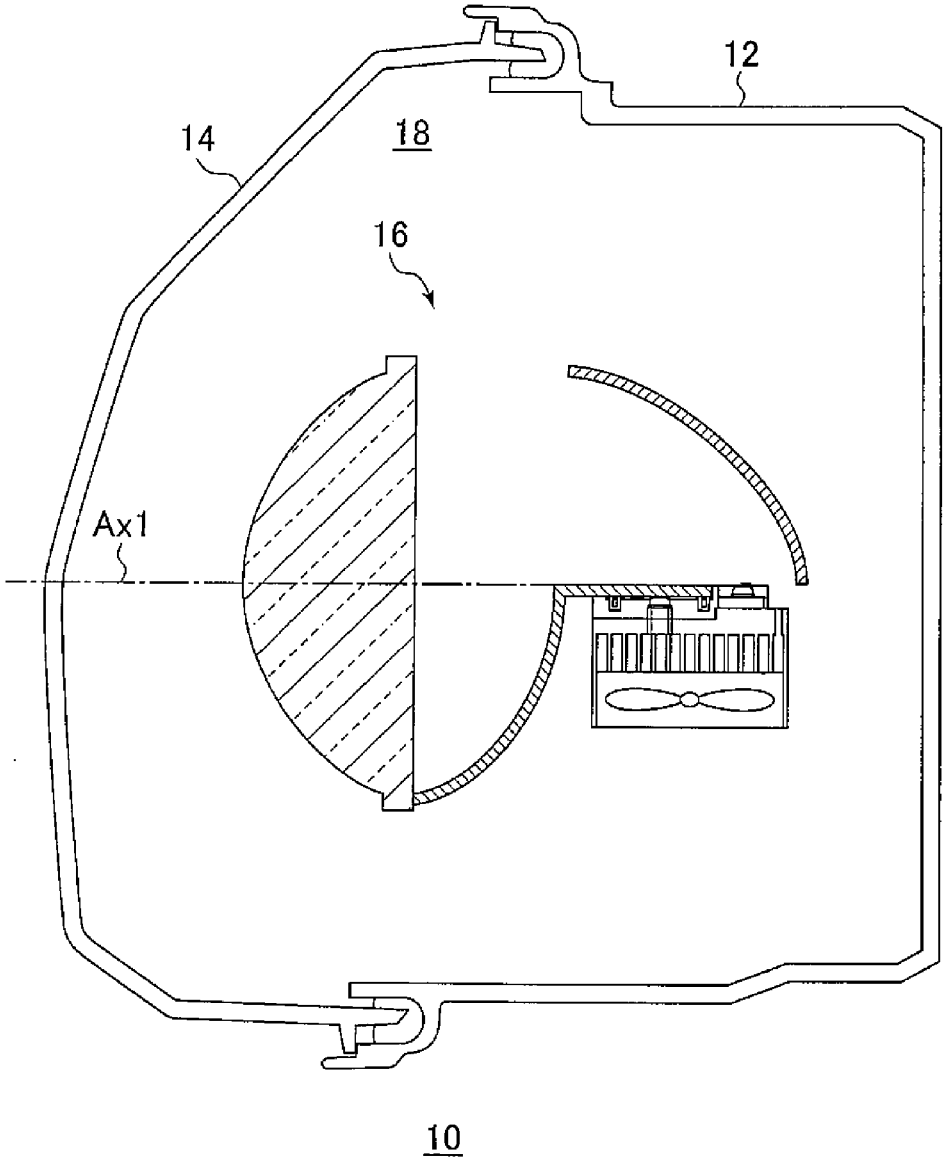
FIG. 1 is a vertical sectional view of the structure of a vehicular lamp according to a first example embodiment of the invention.

Hereinafter, like or equivalent constituent elements and members shown in the drawings will be denoted by like reference characters, and redundant descriptions thereof will be omitted as appropriate. Also, dimensions of members in the drawings are shown enlarged or reduced as appropriate to facilitate understanding. Further, some of the members that are not important for describing the example embodiments are not shown in the drawings.

First Example Embodiment

An overview of the vehicular lamp according to a first example embodiment of the invention will be given. The lamp includes a reflector arranged facing a light source, a heat radiating member that radiates heat generated by the light source, and a fan that cools the heat radiating member. The heat radiating member has a mounting surface to which the light source is mounted, and the fan is provided on the opposite side of the heat radiating member from this mounting surface. A vent is formed through the heat radiating member, from a fan side of the heat radiating member, on which the fan is provided, to a mounting surface side of the heat radiating member, on which the mounting surface is provided. Some of the air from the fan is led to the mounting surface side of the heat radiating member, i.e., toward the reflector, through this vent, such that the reflector is cooled.

FIG. 1 is a vertical sectional view of the structure of a vehicular lamp 10 according to the first example embodiment. The vehicular lamp 10 includes a lamp body 12, an outer cover 14, and a lamp unit 16. Hereinafter, the side where the outer cover 14 is arranged will be described as the front side and the side where the lamp body 12 is arranged will be described as the rear side.

The lamp body 12 is formed in a box-shape with an opening. The outer cover 14 is made of translucent resin or glass that is formed in a bowl-shape. The outer cover 14 is attached to the lamp body 12 so as to cover the opening of the lamp body 12. Accordingly, a lamp chamber 18 is formed by the lamp body 12 and the outer cover 14. The lamp unit 16 is arranged inside the lamp chamber 18. The outer cover 14 transmits light from the lamp unit 16, and the light is radiated forward of the vehicular lamp 10.

Figure 2:
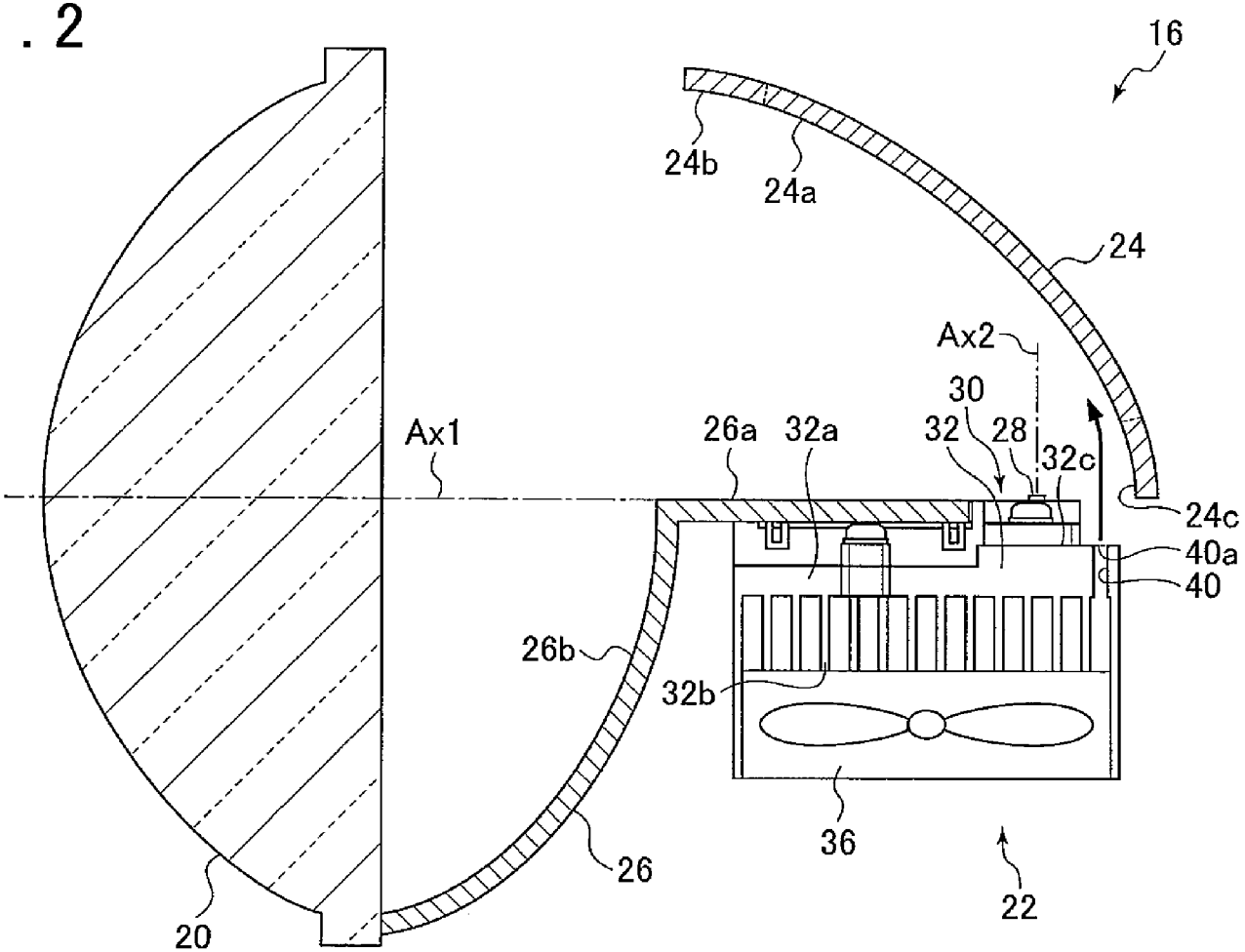
FIG. 2 is an enlarged cross sectional view of a lamp unit in FIG. 1.
Figure 3:
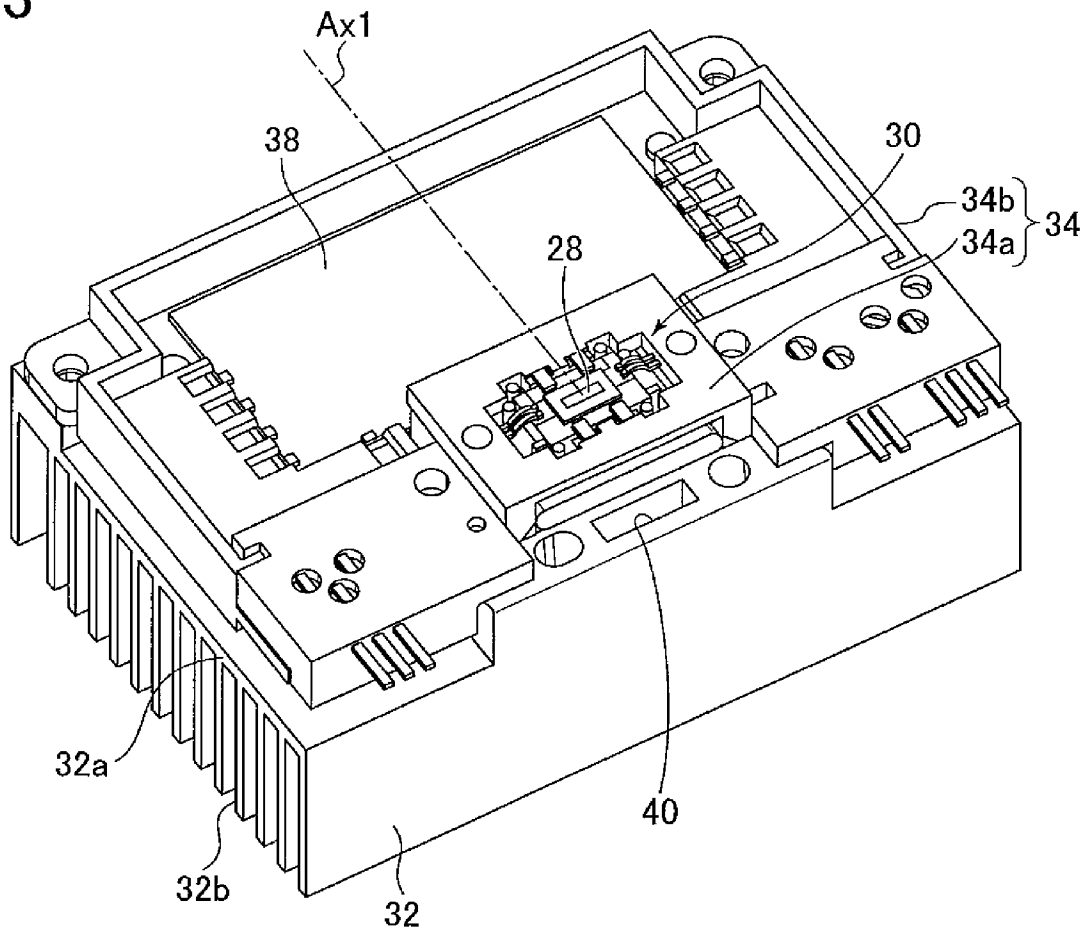
FIG. 3 is a perspective view of the structure of a light-emitting module included in the lamp unit shown in FIG. 2.

FIG. 2 is an enlarged cross sectional view of the lamp unit 16. FIG. 3 is a perspective view of the structure of a light-emitting module 22 included in the lamp unit 16. The lamp unit 16 has a projection lens 20, the light-emitting module 22, a reflector 24, and a shade 26. The projection lens 20 is made of a planoconvex aspherical lens in which a surface on the front side is a convex surface and the surface on the rear side is a flat surface. The projection lens 20 projects a light source image formed on a rear focal plane forward of the vehicular lamp 10 as an inverted image.

The reflector 24 has a reflective surface 24*a* that reflects and condenses light emitted by a light-emitting element 28 (that will be described later). The reflector 24 is arranged above the light-emitting element 28 such that the reflective surface 24*a* faces the light-emitting element 28. More specifically, the reflector 24 is arranged such that an end portion 24*b* on a front side of the reflective surface 24*a* is positioned forward of the light-emitting element 28, and an end portion 24*c* on the rear side of the reflective surface 24*a* is positioned rearward of the light-emitting element 28. The reflector 24 reflects the light from the light-emitting element 28 and forms a light source image on the rear focal plane of the projection lens 20. In this way, the reflector 24 and the projection lens 20 serve as optical members that condense the light emitted by the light-emitting element 28 in front of the vehicular lamp 10.

The shade 26 includes a shade portion 26*a* and a dummy portion 26*b*. The shade portion 26*a* has a flat surface that includes a lamp optical axis Ax1, and forms a cutoff line near the horizontal line of a low-beam distribution pattern. The shape of the shade portion 26*a* is well-known, so a description thereof will be omitted. The dummy portion 26*b* serves as a design member that forms a design surface that is able to be recognized from the outside.

The light-emitting module 22 includes a package 30, a heat sink 32, an attachment 34, a fan 36, and a control circuit board 38. The package 30 includes the light-emitting element 28 that emits light upward. The light-emitting element 28 is formed by an LED that is a semiconductor light-emitting element. The light-emitting element 28 may also be formed by a light-emitting element other than an LED. Also, another light source such as a discharge lamp or an incandescent lamp may also be used instead of the light-emitting element 28.

The control circuit board 38 controls the lighting of the light-emitting element 28. In this example embodiment, the control circuit board 38 is formed by a printed circuit board, not shown, and electrical components and elements, also not shown, mounted to the printed circuit board.

The attachment 34 includes a package fixing portion 34*a* and a circuit housing portion 34*b*. The package fixing portion 34*a* is mounted to the heat sink 32. The package 30 is mounted sandwiched between the package fixing portion 34*a* and the heat sink 32. The circuit housing portion 34*b* is mounted to the heat sink 32. The circuit housing portion 34*b* is formed in a box-shape, and the control circuit board 38 is housed therein.

The heat sink 32 is made of material with good heat radiation properties such as aluminum. An upper surface 32*c* of the heat sink 32 serves as a mounting surface to which the light-emitting element 28 that is included in the package 30 is mounted. The heat sink 32 radiates heat generated by the light-emitting element 28 and the control circuit board 38. The heat sink 32 may also be separated into a first heat sink that radiates heat from the light-emitting element 28, and a second heat sink that radiates heat from the control circuit board 38.

The heat sink 32 includes a main body 32*a* and radiation fins 32*b* provided on a lower portion of the main body 32*a*. Each radiation fin 32*b* is provided extending in the lateral direction of the vehicular lamp 10, a direction orthogonal to the lamp optical axis Ax1. Therefore, the radiation fins 32*b* also serve as guides that guide air blown at the heat sink 32 in the lateral direction of the vehicular lamp 10. The fan 36 is attached to the heat sink 32 below the radiation fins 32*b* so as to be able to blow air at the radiation fins 32*b* to radiate the heat generated by the light-emitting element 28 and the control circuit board 38.

A vent 40 that extends through from the fan side of the heat sink 32 on which the fan 36 is provided to the mounting surface side of the heat sink 32 on which the mounting surface (i.e., the upper surface 32*c*) side is provided, is formed in the heat sink 32. In this embodiment, the vent 40 extends through the heat sink in the vertical direction of the vehicular lamp 10, a direction orthogonal to the lamp optical axis Ax1. More specifically, the vent 40 is formed such that an open end 40*a* on the mounting surface side of the heat sink 32 is positioned between the light-emitting element 28 and the end portion 24*c* on the rear side of the reflective surface 24*a*, in the direction parallel to the lamp optical axis Ax1. Also, the vent 40 is formed such that air that flows out from the open end 40*a* reaches the end portion 24*c* on the rear side of the reflective surface 24*a*. In one example, the vent 40 is formed extending through the heat sink 32 parallel to a main optical axis Ax2. The main optical axis Ax2 refers to an axis that is perpendicular to a main light-emitting surface as an upper surface of the light-emitting element 28, and that passes through the center of the main light emitting surface.

Some of the air from the fan 36 is led through the vent 40 to the end portion 24*c* on the rear side of the reflective surface 24*a* of the reflector 24, and flows toward the end portion 24*b* on the front side along the reflective surface 24*a*. At this time, heat exchange is performed between the reflector 24 and the air, such that the reflector 24 is cooled. Leading air from the fan 36 to the end portion 24*c* on the rear side of the reflective surface 24*a* in this way enables the entire reflector 24 to be cooled.

Also, the flow of air coming through the vent 40 causes the air inside the lamp unit 16, i.e., the air inside the space surrounded by the projection lens 20, the shade 26, the light-emitting element 28, and the reflector 24, to flow out of the lamp unit 16 through a gap between the projection lens 20 and the reflector 24. That is, air heated by the light-emitting element 28 will not tend to stay in the lamp unit 16. Therefore, the reflector 24, the projection lens 20, and the light-emitting element 28 are able to be maintained at a relatively low temperature.

Second Example Embodiment

Figure 4:
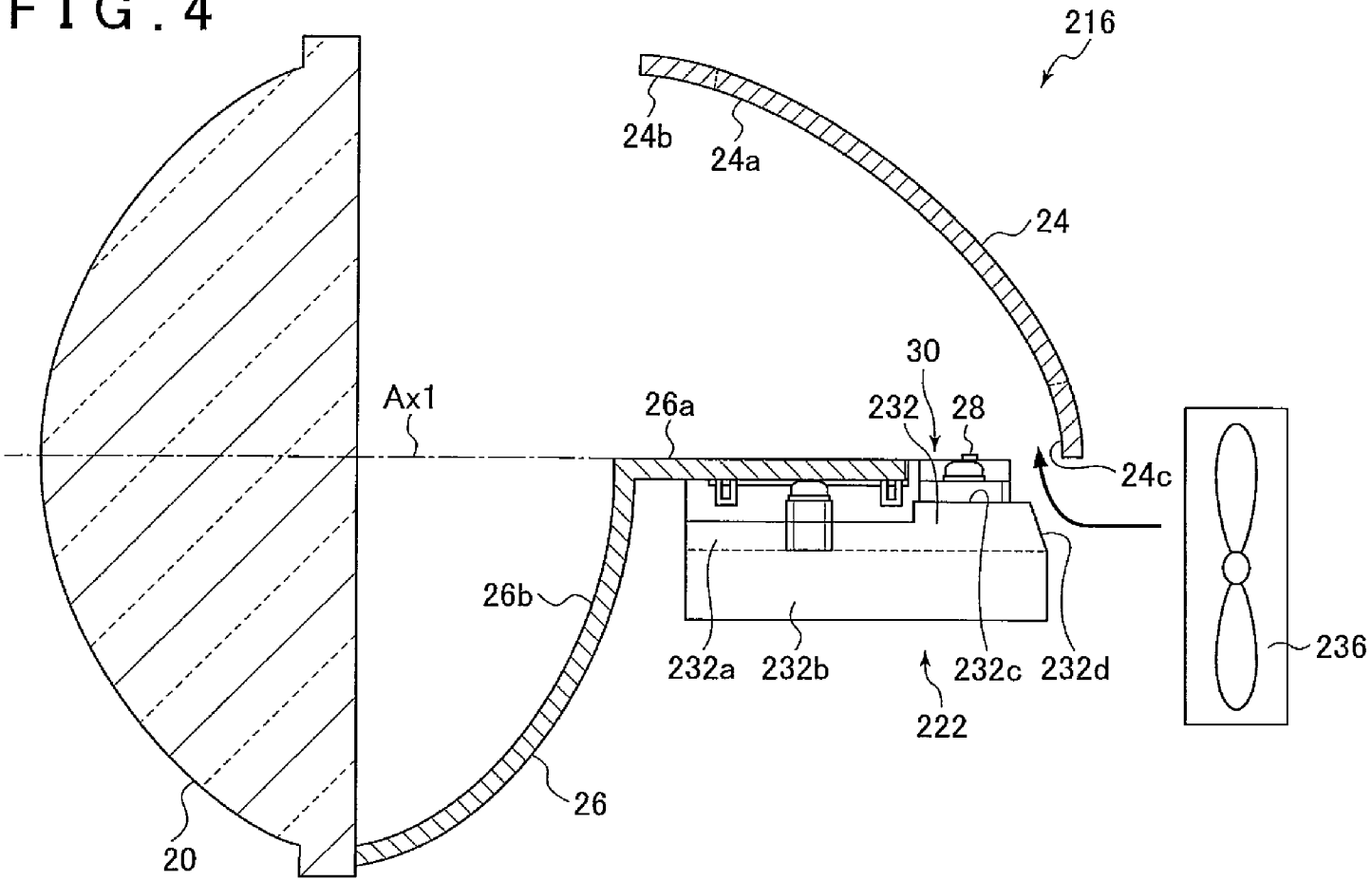
FIG. 4 is an enlarged cross sectional view of a lamp unit of a vehicular lamp according to a second example embodiment of the invention.

The main difference between a vehicular lamp according to a second example embodiment of the invention and the vehicular lamp 10 according to the first example embodiment is the shape of the heat sink. FIG. 4 is an enlarged cross sectional view of a vehicular lamp unit 216 according to the second example embodiment. FIG. 4 corresponds to FIG. 2. In contrast to the heat sink 32 in FIG. 2, a heat sink 232 in the second example embodiment does not have a vent.

A fan 236 is provided to the rear of the heat sink 232 and blows air toward the heat sink 232. Therefore, radiation fins 232*b* are provided extending in the direction parallel to the lamp optical axis Ax1.

An inclined surface 232*d* that is inclined forward at a predetermined angle is formed on a rear end of the heat sink 232. As a result, air from the fan 236 is led to the reflective surface 24*a* of the reflector 24. That is, the inclined surface 232*d* serves as an air blowing guide that leads air to the reflective surface 24*a* of the reflector 24. According to this example embodiment, effects similar to those of the vehicular lamp 10 according to the first example embodiment are able to be obtained.

Third Example Embodiment

Figure 5:
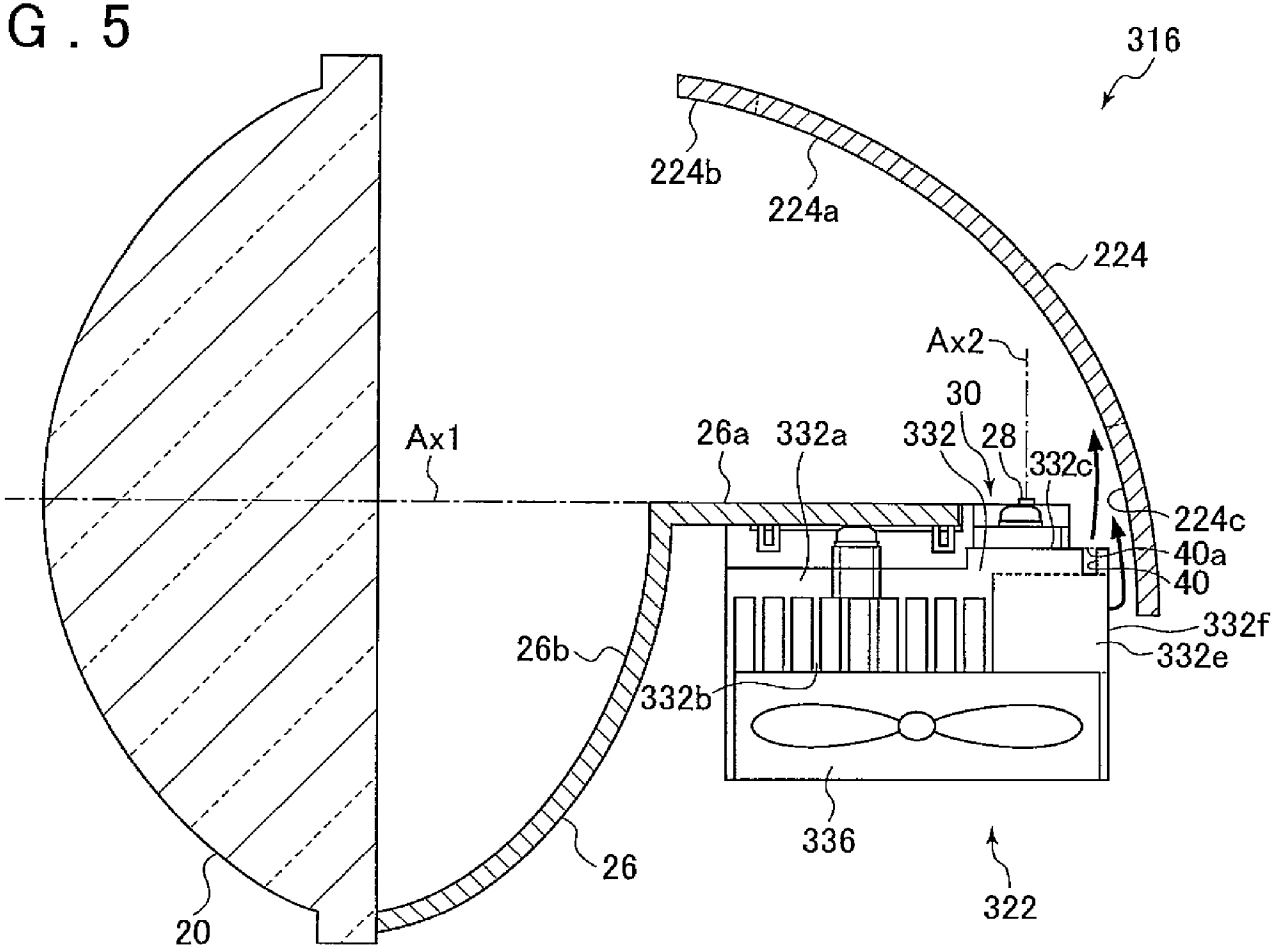
FIG. 5 is an enlarged cross sectional view of a lamp unit of a vehicular lamp according to a third example embodiment of the invention.
Figure 6:
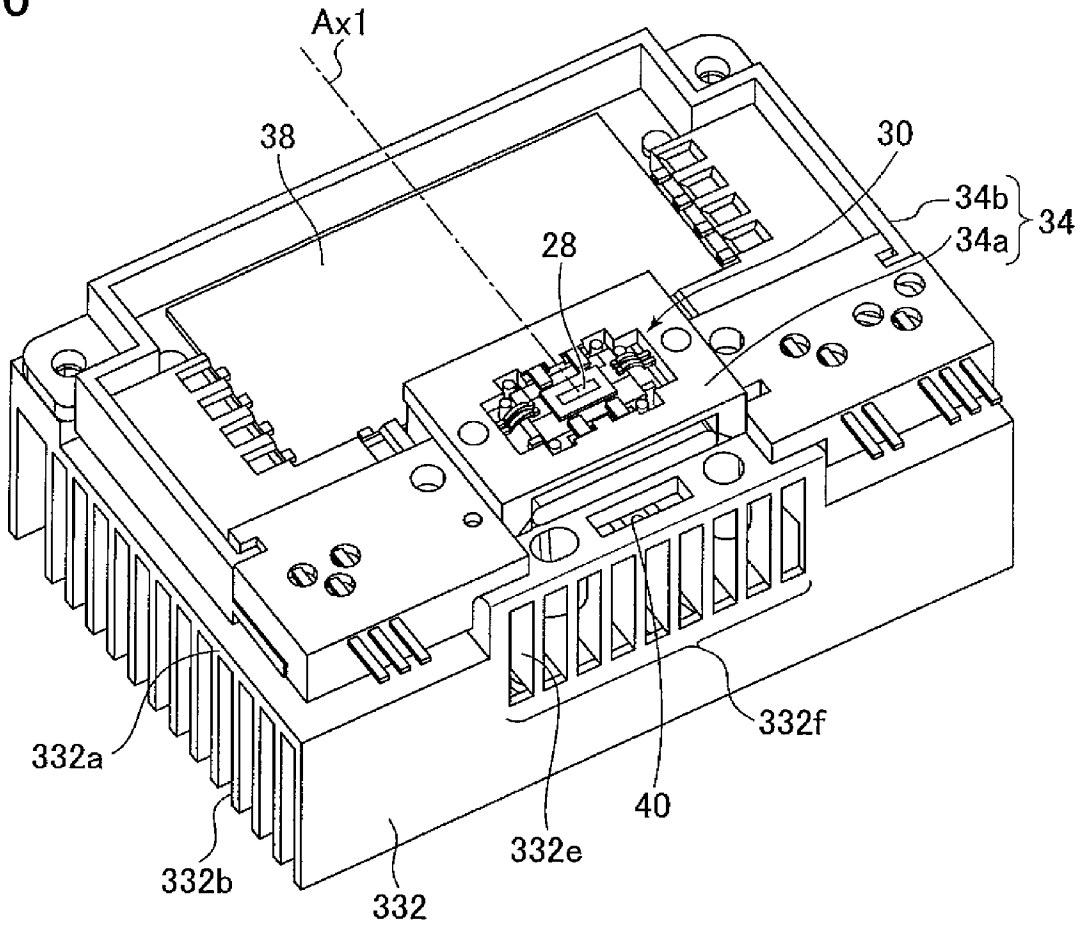
FIG. 6 is a perspective view of the structure of a light-emitting module included in the lamp unit shown in FIG. 5.
Figure 7:
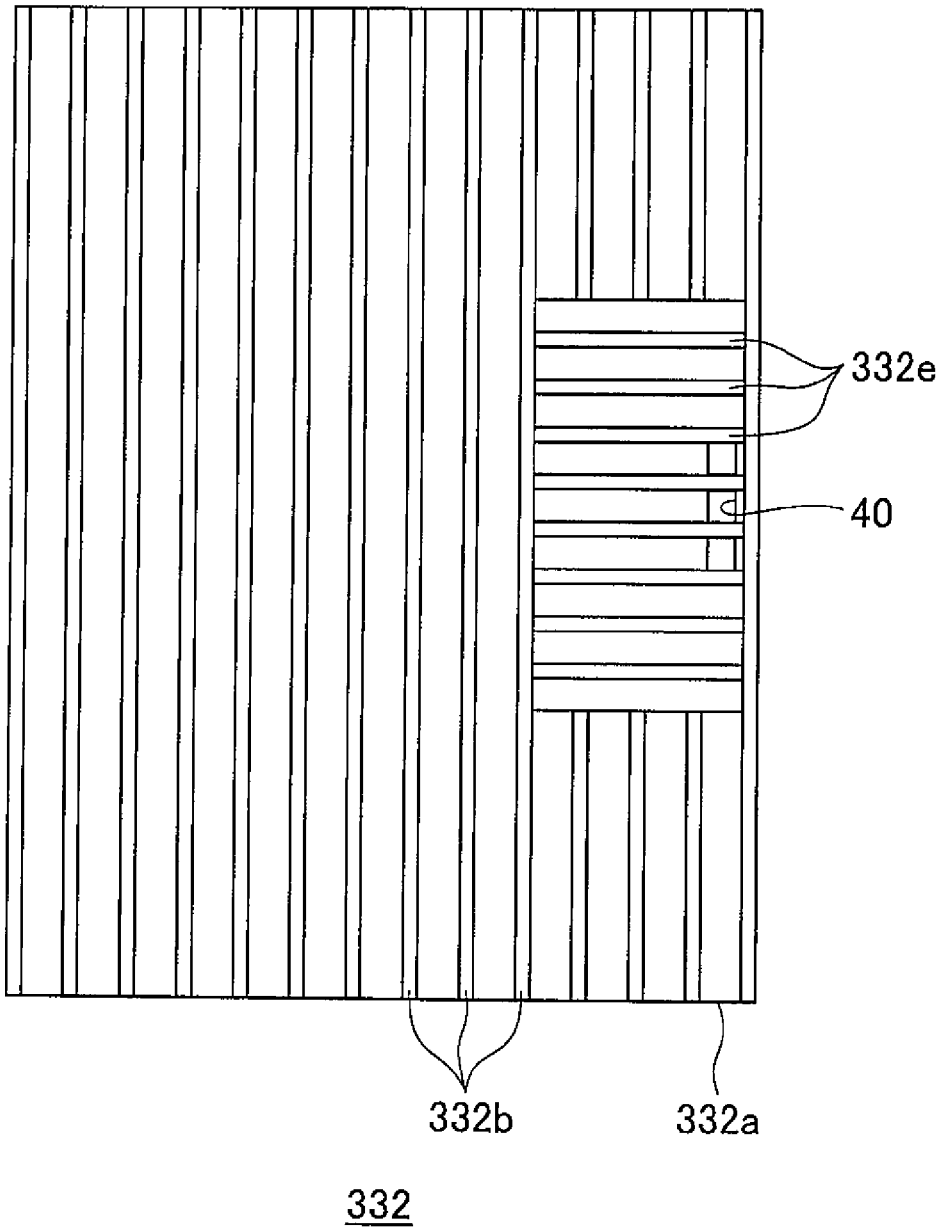
FIG. 7 is a bottom view of a heat sink in FIG. 5.

The main difference between a vehicular lamp according to a third example embodiment of the invention and the vehicular lamp 10 according to the first example embodiment is the shape of the heat sink and the shape of the reflector. FIG. 5 is an enlarged cross sectional view of a vehicular lamp unit 316 according to the third example embodiment. FIG. 6 is a perspective view of the structure of a light-emitting module 322 included in the vehicular lamp unit 316. FIG. 7 is a bottom view of the heat sink. FIGS. 5 and 6 correspond to FIGS. 2 and 3, respectively.

The light-emitting element 28 is positioned to the rear of the center of a heat sink 332. In addition to first radiation fins 332*b* that are provided extending in the lateral direction of the vehicular lamp, the heat sink 332 also has second radiation fins 332*e* provided extending in the direction parallel to the lamp optical axis Ax1. More specifically, the heat sink 332 has the second radiation fins 332*e* only on a portion directly below the light-emitting element 28 positioned to the rear of the center of the heat sink 332.

That is, the second radiation fins 332*e* are provided to guide air that is directly below the light-emitting element 28 toward the rear. In other words, the second radiation fins 332*e* are provided to guide the air that is directly below the light-emitting element 28 toward the rear side surface of the heat sink 232. The air that is guided toward the rear by these second radiation fins 332*e* is discharged out of the heat sink 332 through a rear vent 332*f* provided in a rear side surface. As a result, the portion directly below the light-emitting element 28 that tends to become comparatively high in temperature is able to be efficiently cooled, and as a result, the light-emitting element 28 is able to be more efficiently cooled.

A reflector 224 is formed with a rear end portion 224*c* facing at least a portion of the rear vent 332*f* in the direction of the lamp optical axis Ax1. Therefore, some of the air guided to the second radiation fins 332*e* and discharged through the rear vent 332*f* is blown at the rear end portion 224*c* of the reflector 224, and led along a reflective surface 224*a* of the reflector 224 to the high-temperature portion directly above the LED. That is, according to this example embodiment, air is able to be led to the reflective surface 224*a* of the reflector 224 from the rear vent 332*f* as well as the vent 40, thus enabling the reflector 24 to be cooled. The component part of the package 30 and the like is not mounted to the rear side surface of the heat sink 332, so the rear vent 332*f* is able to be formed relatively large. Therefore, a larger amount of air is able to be led toward the reflector 224 from the rear vent 332*f* than an amount of air let from the vent 40.

Next, test results to confirm the cooling effect of this example embodiment will be described. More specifically, the temperatures (junction temperature (Tj)) of the light-emitting element 28 of a vehicular lamp according to a comparative example provided with a heat sink having only fins extending in the lateral direction of the vehicular lamp, and the light-emitting element 28 of the vehicular lamp according to this example embodiment were measured. The test results are shown in Table 1. As shown in Table 1, it is evident that the junction temperature of the vehicular lamp according to this example embodiment is lower than the junction temperature of the vehicular lamp according to the comparative example.

TABLE 1

| | Junction temperature (Tj) |
|---|---|
| Comparative example | 64.7° C. |
| Example embodiment | 62° C. |

Heretofore, the invention is described based on example embodiments. These example embodiments are only examples. The combinations of processes and constituent elements may be modified in any of a variety of ways, and these modified examples are also within the scope of the invention.

First Modified Example

Figure 8:
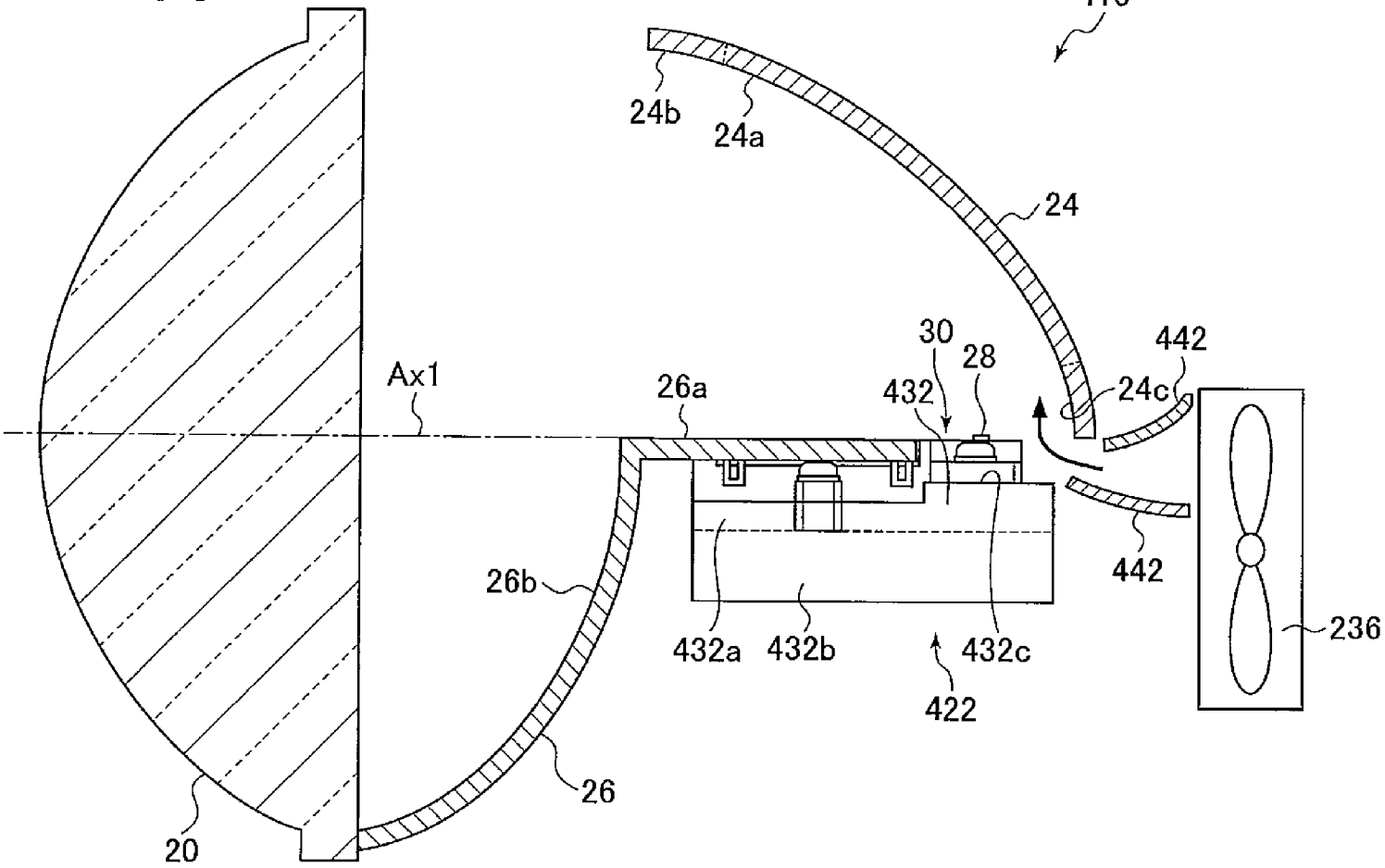
FIG. 8 is an enlarged cross sectional view of a lamp unit of a vehicular lamp according to a modified example of the second example embodiment.

FIG. 8 is an enlarged cross sectional view of a lamp unit 416 of a vehicular lamp according to a modified example of the second example embodiment. In this modified example, a heat sink 432 does not have an inclined surface. Instead, the lamp unit 416 has a duct 442. This duct 442 guides some of the air blown from the fan 236 toward the radiation fins 232*b* of the heat sink 232 to a gap between the reflector 24 and the heat sink 232. As a result, some of the air from the fan 236 is led to the reflective surface 24*a* of the reflector 24. That is, the duct 442 serves as an air blowing guide that leads air to the reflective surface 24*a* of the reflector 24. According to this modified example, effects similar to those of the vehicular lamp according to the second example embodiment are able to be obtained. In this modified example, the fan 236 is not limited to being provided to the rear of the heat sink 432. That is, the fan 236 may also be provided in another position.

What is claimed is:

1. A vehicular lamp comprising:

an optical member having a reflective surface that reflects light from a light source;

a heat radiating member configured to radiate heat generated by the light source; and a blowing mechanism configured to blow air at the reflective surface, and a fan configured to blow air to the heat radiating member, wherein the blowing mechanism is configured to lead air blown from the fan to the reflective surface of the optical member;

the heat radiating member has a mounting surface to which the light source is mounted;

the fan is provided on a fan side of the heat radiating member, the fan side of the heat radiating member being an opposite side of the heat radiating member from the mounting surface; and the blowing mechanism includes a vent that extends through the heat radiating member from the fan side of the heat radiating member to a mounting surface side of the heat radiating member.

2. The vehicular lamp according to claim 1, wherein:

the mounting surface is an upper surface of the heat radiating member; and the fan is mounted below the heat radiating member.

3. The vehicle lamp according to claim 1, wherein:

the reflective surface is arranged facing the light source, and configured to control a distribution of light from the light source on a road surface;

one end of the reflective surface is positioned rearward of the light source, and the other end of the reflective surface is positioned forward of the one end of the reflective surface; and the vent is formed such that an open end on the mounting surface side of the heat radiating member is positioned between the light source and the one end of the reflective surface, in a direction parallel to an optical axis of the vehicular lamp.

4. The vehicular lamp according to claim 3, wherein:

the heat radiating member includes radiation fins that are provided on at least a portion corresponding to the light source, and extend to a rear side surface of the heat radiating member, in the direction parallel to the optical axis of the vehicular lamp;

a rear vent is provided in the rear side surface of the heat radiating member; and the reflective surface is formed such that the one end of the reflective surface faces at least a portion of the rear vent in the optical axis direction.

5. The vehicular lamp according to claim 1, wherein the blowing mechanism is an air blowing guide configured to lead air blown from the fan to the optical member.

6. The vehicular lamp according to claim 5, wherein the fan is provided rearward of the heat radiating member.

7. The vehicular lamp according to claim 6, wherein the air blowing guide is an inclined surface that is inclined forward at a predetermined angle and is formed on a rear end of the heat radiating member.

8. The vehicular lamp according to claim 6, wherein the air blowing guide is a duct that guides air blown from the fan to a gap between the optical member and the heat radiating member.

* * * * *